United States Patent [19]

Murase et al.

[11] 4,404,771

[45] Sep. 20, 1983

[54] ROLLER ASSEMBLY FOR SLIDING CLOSURES

[75] Inventors: Yasushi Murase; Tosiyuki Kanegae; Hideaki Mitsuzawa; Tosiyuki Tatsumi, all of Isehara, Japan

[73] Assignees: The Nippon Aluminum Mfg. Co., Ltd., Osaka; Nippon Alumi Jutaku-Kenzai Kogyo Co., Ltd., Kanagawa, both of Japan; The Nippon Aluminum Mfg. Co., Ltd., Osaka; Nippon Alumi Jutaku-Kenzai Kogyo Co., Ltd., both of Japan

[21] Appl. No.: 347,357

[22] Filed: Feb. 9, 1982

[30] Foreign Application Priority Data

Feb. 17, 1981 [JP] Japan ..... 56-22426

[51] Int. Cl.[3] ..... E05D 13/02

[52] U.S. Cl. ..... 49/425; 49/420; 16/99; 16/105

[58] Field of Search ..... 49/420, 425; 16/99, 16/105

[56] References Cited

U.S. PATENT DOCUMENTS 3,670,357 6/1972 Steigewald ..... 49/425 X

FOREIGN PATENT DOCUMENTS 52-49642 4/1977 Japan ..... 49/425

1275462 5/1972 United Kingdom ..... 49/425

*Primary Examiner*—Kenneth Downey

*Attorney, Agent, or Firm*—Browdy and Neimark; Browdy and Neimark

[57] ABSTRACT

A door roller provided with an engagement arm which is capable of being engaged with, by an engaging member attached to an upwardly bent end of the engaging arm, a guide groove formed with a downward opening longitudinally along a lower frame of a window structure for preventing a sliding door from an accidental removal. An inner housing retaining a tire shaft is rotatably pivoted to an outer housing of the door roller via another axis parallel to the tire shaft. The engagement arm which is engaged with the inner housing by way of an engaging mechanism is disposed freely movable upwards and downwards in relation to the outer housing. The engaging mechanism is located at a further position than the tire shaft from the another axis such that the engagement arm may be moved vertically, when the tire has been ascended or descended by a predetermined amount, by a larger amount than or an approx. equal amount to the predetermined amount in relation to the outer housing.

11 Claims, 15 Drawing Figures

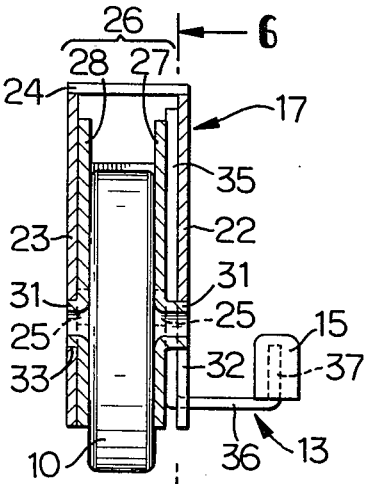
FIG. 4
FIG. 5
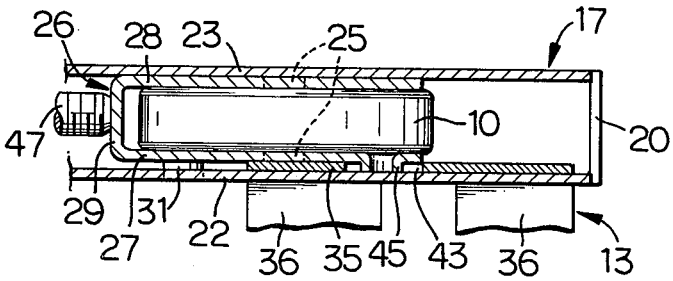
FIG. 6
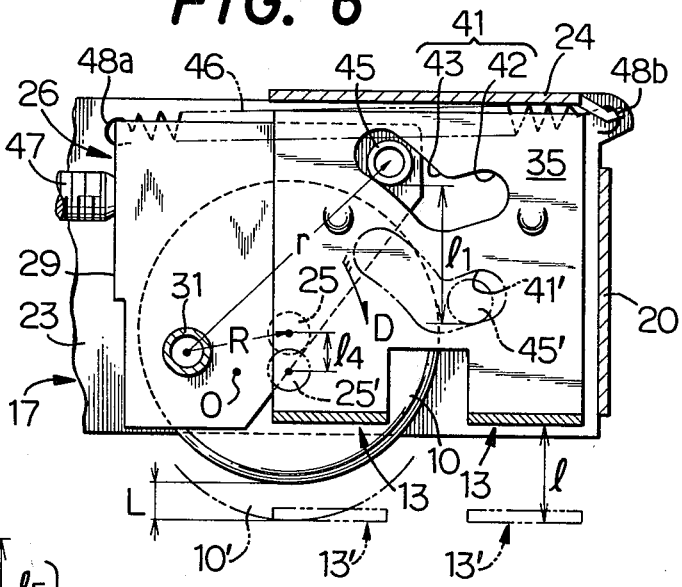
FIG. 7
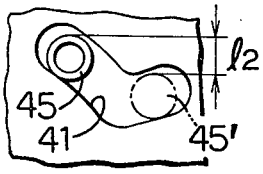
FIG. 8
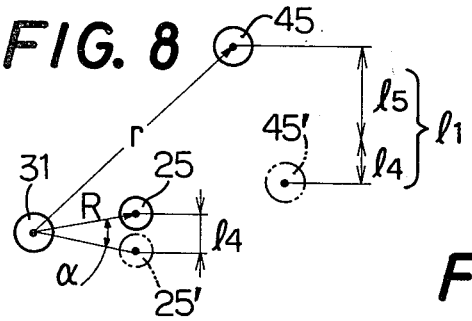
FIG. 9
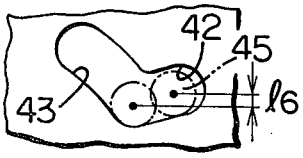
FIG. 10
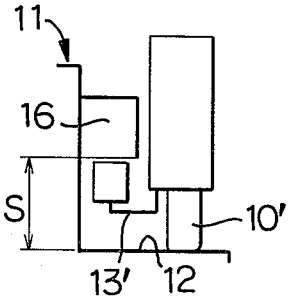
FIG. 11
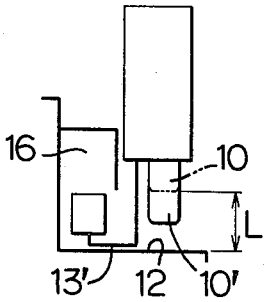

ROLLER ASSEMBLY FOR SLIDING CLOSURES

BACKGROUND OF THE INVENTION

The present invention relates to a roller assembly used for closures and in particular to a roller assembly for sliding doors and windows in an opening of homes and other building structures easy in mounting and removal thereof.

A sliding closure which is mounted on a structure defining an opening of homes and other buildings is generally consisted of a plurality of flat sliding members, movable relative to one another in spaced-apart parallel planes from a closed position to an open position or vice versa guided by tracks or rails for the sliding members, so that the opening may be opened or closed according to the need. A sliding closure of this type is generally known as sliding doors, windows and screens, etc.

In one of conventional ways of moving the sliding members as a structural component of such a sliding closure within the opening parallel to the plane of the sliding member, a guide groove or grooves and provided in the lower portion of a frame of the opening structure just like in the upper portion of the same so that either the upper and lower portion of the sliding member may be moved in both guide grooves by simple sliding or rolling by way of a roller or rollers attached to the lower side of the sliding member.

In another of the conventional ways a suitable number of rails are provided in the lower portion of the structure frame, while the sliding member(s) being provided with a roller or rollers on the lower side thereof, so as to allow the sliding member(s) to move along the rails.

The guiding structure for the sliding members mentioned above are all obliged to contain in the lower portion of the structure frame grooves or rails which are susceptible to accumulation of dust and dirt. The structure frame with such guide grooves or rails provides problems of collecting dust therein and hampering perfect cleaning thereof.

A proposition of making the lower surface of the structure frame for running the sliding members a flat plane is made. The proposition is however problematical in having no regulation for the movement of the sliding members in a perpendicular direction to the plane of the above-mentioned opening such as a window, which after allows the sliding members to get out of the frame. Providing of some preventive engagement mechanism between the sliding members and the structure frame creates another problem of making the attachment of the sliding members to the structure frame difficult because of complication of the construction.

SUMMARY OF THE INVENTION

A principal object of this invention is to provide a roller assembly for a sliding closure making putting in place and removing of the sliding closure to and from the frame of the opening structure easy.

Another object of this invention is to provide a sliding closure wherein an engagement arm means engageable with the structure frame is disposed separately from a door roller, for the purpose of making the running way for the door roller flat by doing away the rails and grooves, so as to prevent the sliding members such as sliding doors from getting out of the frame, whereby the engagement arm means can be automatically engaged with and disengaged from the structure frame when the sliding member is put in place or removed.

Other objects of this invention will become apparent to those skilled in the art from the following detailed description of the preferred embodiments when read in conjunction with the accompanying drawings.

For attaining the above-mentioned objects, a sliding closure in accordance with this invention, which is mounted on a structure defining an opening and which moves toward and transversely to a plane in which the opening lies for moving a portion of the closure in a direction toward the plane, is provided with a roller assembly which characteristically comprises a roller body; an inner housing having a first rotation axis for rotatably retaining the roller body; an outer housing attached to the sliding closure for accommodating the inner housing therein so as to be rotatable about a pivotal second axis which is located at a separate position from, and is parallel to, the first axis; a biasing means anchored between the inner housing and the outer housing for biasing the inner housing rotatably about the second axis such that at least a part of the roller body can be exposed outside from a lower opening of the outer housing; and an engagement arm means which is vertically movable according to the rotational movement of the inner housing about the second axis and is thereby capable of preventing the closure from getting out of the structure by means of being engaged, when it is ascended, with a guide groove which is formed on a vertical wall portion of the step-like form along the longitudinal direction thereof.

According to a preferable mode of this invention, the above-mentioned engagement arm means is constructed such that, when the roller body is moved upwards or downwards by a predetermined amount in relation to the outer housing it can be ascended or descended in relation to the outer housing by an amount larger than or an amount approx. equal to the predetermined value. The engagement and disengagement between the engagement arm means and the structure is thereby, in the event of putting in place or removing of the sliding closure to and from the structure frame, made remarkably easy.

Such engagement arms means for preventing an accidental release of the door roller from the structure frame is, further concretely speaking, provided with an internal sliding portion which is interposed between the inner housing and the outer housing being engaged with the inner housing by way of an engaging mechanism, so as to be slidable up and down between both housings due to rotation of the inner housing; a connecting portion extending laterally from the lower portion of the internal sliding portion by way of an opening end on the lower side of the outer housing; a rising portion upwardly bent from the end of the connecting portion, and an engagement member attached to the rising portion for being slidably engaged with a guide groove formed in the structure frame.

An engagement arm means of this type is further provided in the internal sliding portion with a slit, which is preferably composed of an arcuate portion and a straight line portion, for movably accommodating an engaging protrusion formed on the inner housing, so that it may be moved upwards and downwards according to rotation of the inner housing.

Other features and advantages of this invention will be easily understood by those skilled in the art when the preferred embodiments described hereunder in detail are studied in conjunction with the appended drawings.

BRIEF DESCRIPTION OF THE DRAWINGS

FIGS. 4 and 5 are respectively a schematic sectional view taken along sectional lines 4—4 and 5—5 in FIG. 3;

FIG. 6 is a partial schematic sectional view taken along a sectional line 6—6 in FIG. 4;

FIGS. 7 and 9 are respectively an explanatory view illustrating the moving condition of a pin disposed on the inner housing within a slit formed in a vertical wall of the engagement arm means;

FIG. 8 is a partial schematic view for explaining operation of the roller assembly in relation to FIG. 6;

FIGS. 10 and 11 are respectively a partial schematic view corresponding to the roller assembly attaching portion in FIG. 2, but illustrating a dissimilar relation between the engagement arm means and the tyre from that in FIG. 2;

DETAILED DESCRIPTION OF THE PREFERRED EMBODIMENTS

Figure 1:
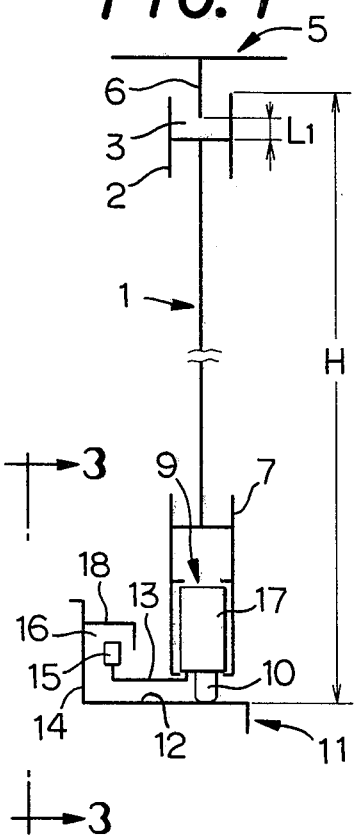
FIG. 1 is a vertical sectional schematic view of a sliding door in which a roller assembly of this invention is mounted.

In FIG. 1 of a vertical sectional schematic view, a sliding door 1 or a sliding glass door assembly, i.e., one of the sliding members constituting a sliding closure which is put in a rectangular frame of an opening structure in houses or buildings, is to be moved back and forth in a perpendicular direction to the sheet of the drawing. In a groove 3 formed on the upper side of an upper frame 2 of the sliding door 1 a downwardly protruded rib 6 from an upper frame 5 of the opening structure is suspendingly faced to the bottom of the groove 3 with a vertical distance $L_1$ therebetween at an illustrated status in FIG. 1 where the sliding door 1 is rightly located in the structure frame. This is the same manner of placing the sliding door 1 in the structure as in the conventional way. On the lower side of a lower frame 7 of the sliding door 1 a door roller 9 or roller assembly in accordance with this invention is attached such that a tire (roller) 10 of a synthetic resin as a roller body is placed in contact on a substantially flat running surface 12 of a lower frame 11 of the opening structure. The door roller 9 is provided with an engagement arm 13 for precluding the derail or removing of the door extended in a leftwardly projecting manner in FIG. 1, that is to say, directed to the house inside. On the tip of an upwardly bent portion of the engagement arm 13 an engagement portion 15 is formed, which is free slidably accommodated in a guide groove 16 disposed in the lower frame 11 with its opening faced downwardly. Incidentally, the lower frame 11 is so built as to be stepwise elevated toward the inside of the house as shown in the drawing. The flat surface 12 serves as a running way for the tire 10, and a laterally projected wall 18 with an L-shaped bent portion extending from a vertical wall 14 longitudinally along the same, that is in the perpendicular direction to the drawing sheet, so as to define the guide groove 16 therewithin. As later described in detail the tire 10 and the engagement arm 13 are being allowed to protrude by a predetermined amount from a lower end of an outer housing 17 of the door roller 9 such that when the sliding door 1 is lifted upwards, for removing the same from the structure frame for example, by an amount corresponding to the distance $L_1$ shown in FIG. 1, the tire 10 is lowered by an approximately same distance L in relation to the outer housing 17 of the door roller 9 so as to take a position contacting or nearly contacting the flat surface 12, and the engagement arm 13 is also lowered by a longer distance l than that L or an approximately same distance thereto in relation to the outer housing 17 so as to make the engagement portion 15 releasable from the guide groove 16. A two-dot chain line 15 in FIG. 2 designates the position the engagement portion 15 presumably be located when the engagement arm 13 were not lowered by any chance, wherein the relative vertical position in FIG. 2 between the engagement portion 15 and the outer housing 17 coincides with that in FIG. 1.

Figure 3:
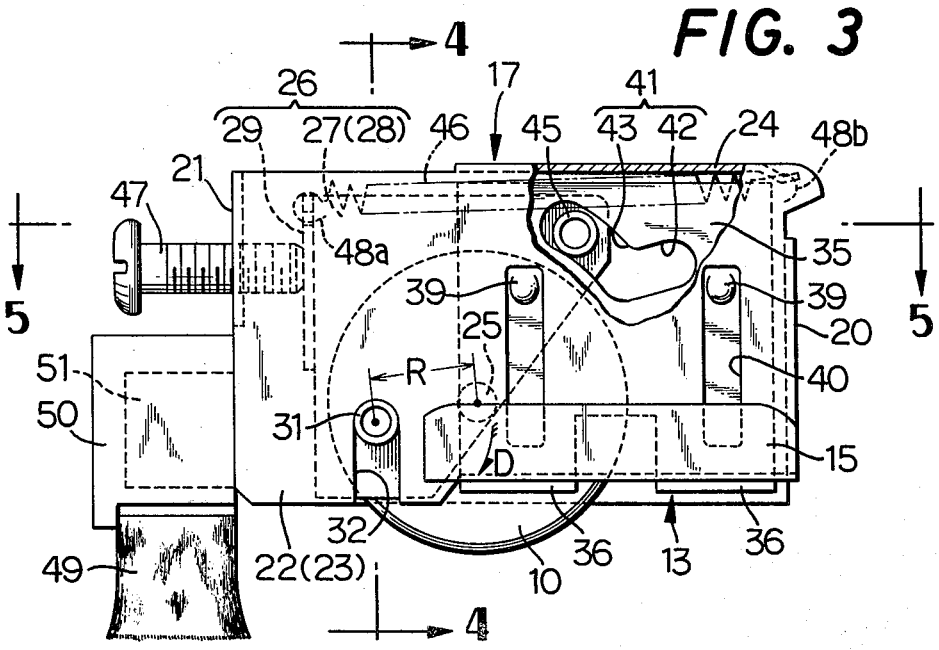
FIG. 3 is a schematic elevational view of an embodiment of the roller assembly according to this invention attached to the sliding door in FIG. 1, seen from a direction illustrated by a line 3—3, with a portion of the drawing being shown as a broken away.

Detail structure of the roller assembly will be described next with reference to the drawing in which FIG. 3 is a schematic elevational view of the door roller 9 in FIG. 1 seen from the direction of the line 3—3 with a partially broken away portion; and FIGS. 4 and 5 are respectively a vertical transverse sectional view of FIG. 3 taken along the section lines 4—4 and 5—5. As clearly seen in FIGS. 3–5, the outer housing 17 is a relatively flat box-like body formed by bending a steel plate, for example, provided with a pair of vertical end walls 20, 21 longitudinal in a vertical direction, a pair of vertical side walls 22, 23, and a top wall 24. The lower side thereof is left open. A shaft 25 for the tire 10 is carried at its both ends as shown in FIGS. 4 and 5 by a pair of vertical side walls 27, 28 of an inner housing 26. The inner housing 26 is also a bent member of a steel plate, for example, both side walls 27, 28 being respectively positioned along the inner surface of the side walls 22, 23 of the outer housing 17. One edge of the side walls 27, 28 nearer to the end wall 21 of the outer housing 17 are connected to an end wall 29. In the lower portion of the side walls 27, 28 a pair of cylindrical pivots 31, 31 are formed by means of drilling a hole and erecting the circumferential edge of the hole outwardly so as to have a desired cylindrical shape. The cylindrical pivots 31, 31 are extended parallelly to the tyre shaft 25, and one cylindrical pivot 31 formed in the side wall 27 is rotatably fitted into a notch 32 formed in the side wall 22 from the lower edge thereof upwardly as shown in FIG. 3. The other cylindrical pivot 31 formed in the side wall 28 is on the other hand rotatably fitted into a bore 33 in the side wall 23 of the outer frame 17 as shown in FIG. 4. The cylindrical pivot 31 is positioned in the lower portion of the outer housing 17 as shown in FIG. 3 rather leftwardly sided in the same figure, that is nearer to the end wall 21. And the shaft 25 is located not so far from the cylindrical pivot 31 with a distance R therebetween. When the tire 10 is in a lifted or ascended position in FIG. 3 the shaft 25 is rightwardly positioned in FIG. 3 relative to the cylindrical pivot 31, that is nearer to the end wall 20.

The engagement arm 13 is positioned nearer to the end wall 20 than the cylindrical pivot 31, and it is provided with a vertical wall 35 slidably interposed between the side wall 22 and the side wall 27 as illustrated in FIGS. 4 and 5. From the lower edge of the vertical wall 35 a horizontal arm portion 36 is extended as an integral projecting part toward the house inside, that is rightwardly in FIG. 4. On the tip of an upward bent portion 37 from the horizontal arm portion 36 the engagement portion 15 is attached. Incidentally, the engagement arm 13 is made of, for example, a bent plate of stainless steel, and the engagement portion 15 is a piece of a synthetic resin. On the external surface of the vertical wall 35 a pair of cut-and-bent projections 39, 39 are formed as can be seen in FIG. 3 for being slidably fitted in a respective vertical slit 40, 40 formed in the side wall 22.

The vertical wall 35 is, as shown in FIG. 6 which is a partial vertical sectional view taken along the line 6—6 in FIG. 4, provided with a slit 41 in the upper part thereof. The slit 41 is provided with a straight portion 42 and an arcuate portion 43 which is extended from the left end of the straight portion 42, that is nearer portion to the cylindrical pivot 31 in FIG. 6, slantly upwards. The portion 42 is the more highly positioned as it is the more distant positioned from the portion 43, exemplary speaking. Within the slit 41 a cylindrical pin 45 integrally formed with the inner housing 26 is slidably fitted. The cylindrical pin 45 is formed, just like the cylindrical pivot 31, by bending while erecting the brim or edge portion of a hole in the inner housing 26. The center O of curvature for the arcuate portion 43 is situated as shown in FIG. 6 lower than the center of cylindrical pivot 31 and in the vicinity of the shaft 25. As later described more in detail, when the cylindrical pin 45 is moved around the cylindrical pivot 31, that is when the inner housing 26 is rotated, the engagement arm 13 is largely moved down, in response to the rotation of the inner housing 26, owing to engagement of the cylindrical pin 45 with the inner edge of the arcuate portion 43 and the straight portion 42. The cylindrical pin 45 is located far away from the cylindrical pivot 31 with a distance r.

On the upper end of the end wall 29 one end 48*a* of a tension coil spring 46 is anchored as shown in FIG. 3. The other end 48*b* thereof is anchored to the end portion of the upper wall 24 rather biased position near the side wall 20. Through a screw hole bored in the end wall 21 an adjusting screw 47 is threaded into from outside so as to abut at the tip thereof onto the end wall 29 of the inner housing 26 as can be seen in FIG. 3. Beneath the adjusting screw 47 a brush 49 is disposed, being planted on the lower side of a stationary piece 50 of a synthetic resin. The piece 50 is firmly attached to projected edges 51, 51 of the side walls 22, 23.

Figure 2:
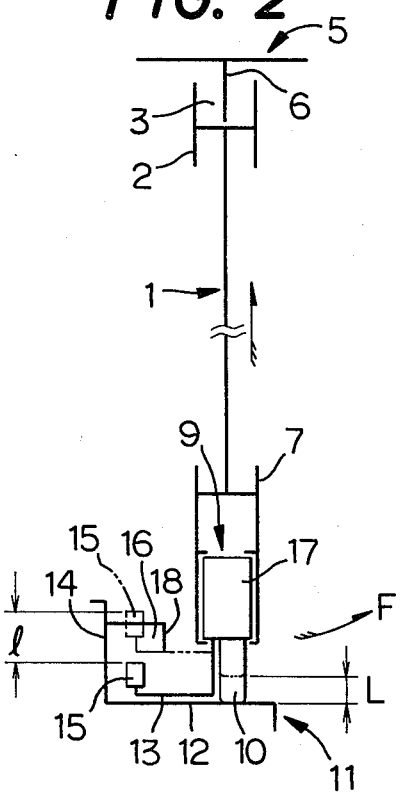
FIG. 2 is a vertical sectional schematic view of the sliding door shown in FIG. 1 for showing a status thereof when it is lifted upwards.

When the sliding door 1 is lifted upwards by an amount of $L_1$ as illustrated in FIG. 2, the inner housing 26 is rotated in a direction marked with an arrow D due to a tension force of the tension coil spring 46 and dead weight of the inner housing 26 and the tire 10, accompanied by lowering of the tire 10 by an amount of L to a position marked with a two-dot-chain line 10' in FIG. 6 and lowering of the pin 45 by a distance $l_1$ to a position marked with a two-dot-chain line 45'. The descending of the pin 45 causes the engagement arm 13 to be lowered by a distance l, owing to urging of the lower edge of the slit 41 by the pin 45, to a position illustrated with a two-dot-chain line 13'. In the above-mentioned operation the descending amount L of the tire 10 depends on a short distance R from the cylindrical pivot 31 to the shaft 25, and the descending amount $l_1$ of the pin 45 depends on a long distance r from the cylindrical pivot 31 to the pin 45. The ratio $l_1$:L becomes therefore very large. The descending amount l of the engagement arm 13 resides in the vicinity of the value of the descending amount $l_1$ of the pin 45. Concretely speaking, $(l_1 \pm l_2)$, a possible result of subtraction or addition between a relative vertical moving amount $l_2$ (a short distance) of the pin 45 within the slit 41 in FIG. 7 and the descending amount $l_1$ seen in FIG. 6, will determine the descending amount l of the engagement arm 13. The descending amount l takes in this way an approximate value to the descending amount $l_1$, so the engagement arm 13 can be lowered in a larger amount than the tire 10 so as to be out of the guide groove 16 as in FIG. 2. This signifies that the door roller 9 can be removed out of the lower frame 11, only by lifting the sliding door 1 upwards, in a direction marked with an arrow F, that is toward outside of the house.

When the sliding door 1 is put into a proper place, the door roller 9 is positioned above the lower frame 11 first while keeping the sliding door 1 in a lifted posture as in FIG. 2 followed by leaving it in a natural status. The sliding door 1 is naturally descended by the dead weight of itself, and the inner housing 26, the pin 45, and the engagement arm 13 all operate reversely to the operation in the removing of the sliding door 1, due to a relative ascending of the door roller 10' in FIG. 6 in relation to the outer housing 17 by the distance L, so as to cause the engagement portion 15 to be fitted into the guide groove 16 due to a larger ascending as shown in FIG. 1 of the engagement portion 15 by the distance l (in FIG. 2). When the sliding door 1 is once put in the proper place the door roller 9 can not be derailed from the lower frame 11 by virtue of the fitting of the engagement portion 15 into the guide groove 16. When the gap $L_1$ observed on the top of the sliding door 1 properly put in place shown in FIG. 1 is too large, all have to be done is to turn the adjusting screw 47 in FIG. 3 for urging the end wall 29 of the inner housing 26. Rotation of the inner housing 26 in the arrow D direction will lower the tire 10, with a result of increasing a height H from the tire 10 to the upper frame 2 in FIG. 1. The gap $L_1$ will be adjusted to a suitable value. If the gap $L_1$ is too small, reverse turning of the adjusting screw 47 for decreasing the height H will solve the problem easily.

The description will be proceeded further to the engagement structure around the slit 41 and the cylindrical pin 45. First of all the arcuate portion 43 of the slit 41 will be explained, which is disposed in consideration of the adjusting operation by the adjusting screw 47 shown in FIG. 3.

Corresponding to the maximum movement distance of the adjusting screw 47, between the zero-adjustment point where the screw 47 is retracted outwardly to the maximum extent and the maximum adjustment point where the screw 47 is threaded into to the greatest possible extent, the pin 45 requires a certain predetermined distance along which it is rotated presuming the cylindrical pivot 31 as a fulcrum therefor. In other words, dimension and shape of the arcuate portion 43, and relative positioning between the cylindrical pivot 31 and the curvature center O are determined such that the engagement arm 13 can be lowered downwardly by an approximately equal amount to the distance $l_a$ the shaft 25 is rotated about the cylindrical pivot 31 according to the rotation of the inner housing 26. When therefore the adjusting screw 47 is threaded into so as to make the inner housing 26 rotate about the pivot 31 by the just adjusted amount the pin 45 slides along the arcuate portion 43 to lower the engagement arm 13 by the above-mentioned adjusting amount. In the putting operation of the sliding door 1 in place, when the pin 45 passes a curve transition point, i.e., a crossing point of the straight portion 42 and the arcuate portion 43, the engagement arm 13 which has been moved just by the moving distance of the tire 10 abruptly increases its movement distance due to the action of the pin 45 sliding along the straight portion 42 for being lowered a great deal. Although the straight portion 42 in the embodiment illustrated is slightly slant in upward trend, when the shaft 25 is moved by a distance $l_4$ by its rotation about the pivot 31 by an angle $\alpha$ as shown in FIG. 8, the rotational radius r of the pin 45 is larger than the rotational radius R of the shaft 25, i.e., $R<r$, so the vertical movement distance of the pin 45 shows a larger value $(l_4+l_5)$ than the above-mentioned distance $l_4$, with a result of a larger descending of the pin 45 than the shaft 25 by a distance $l_5$. Moreover, the pin 45 relatively moves along the straight portion 42 according to the inclination of the same portion 42 as shown in FIG. 9 by a distance $l_6$, with a subsequent result of further descending of the engagement arm 13 by the distance $l_6$. It signifies that the engagement arm 13 is lowered more than the tire 10 and the shaft 25 by an amount equal to the sum of the two kinds distances $l_5$ and $l_6$, that is $(l_5+l_6)$. Out of the two component portions of the slit 41, i.e., the straight portion 42 and the arcuate portion 43, the latter plays a role as an adjusting portion wherein the engagement arm 13 ascends and descends by an approximately equal distance with the tire 10 when the pin 45 moves within the stretch of the arcuate portion 43, while the straight portion 42 plays a role of causing the engagement arm 13 to be ascended and descended in a larger amount than the tire 10.

In the above-mentioned structure the engagement arm 13 is separately disposed from the tire 10, permitting the tyre running flat surface 12 as in FIG. 1 truly flat, which enables cleaning of the lower frame to be quite easy. When the sliding door 1 is put in place or released out of the structure frame engagement and disengagement of the engagement arm 13 can be automatically performed, bringing about no problem for the putting in and removing of the sliding door 1.

As can be observed in FIG. 2, every component part in the previous embodiment is arranged such that the lowest end of the engagement arm 13' in FIG. 2 is aligned when it is descended to the lowest position with the lowest end of the tire 10, by means of being held at an approximately same level. Merits incurred from the above structure can be well understood from the following description: As can be seen in FIG. 10, when the lower surface of the engagement arm 13' is higher than that of the tire 10', a gap S between the lower end of the guide groove 16 formed on the lower frame 11 and the flat surface 12 thereof must be widened, which inevitably enlarges the size of the lower frame 11; and when the lower end of the tire 10' is positioned higher than the engagement arm 13' as can be seen in FIG. 11 the lifting amount L of the sliding door 1 is required to be large, bringing about not a small trouble for the putting in and removing of the sliding door 1.

When this invention is realized in practice the position of the center of curvature O for the arcuate portion 43, in FIG. 6, can be varied in many ways, and the size and shape of the arcuate portion 43 may be altered in any way, so long as the above-mentioned operation for the engagement arm 13 can be smoothly performed. Even modification of the straight portion 42 into arcuate shape is allowed if no trouble takes place for smooth operation of the engagement arm 13.

Figure 12:
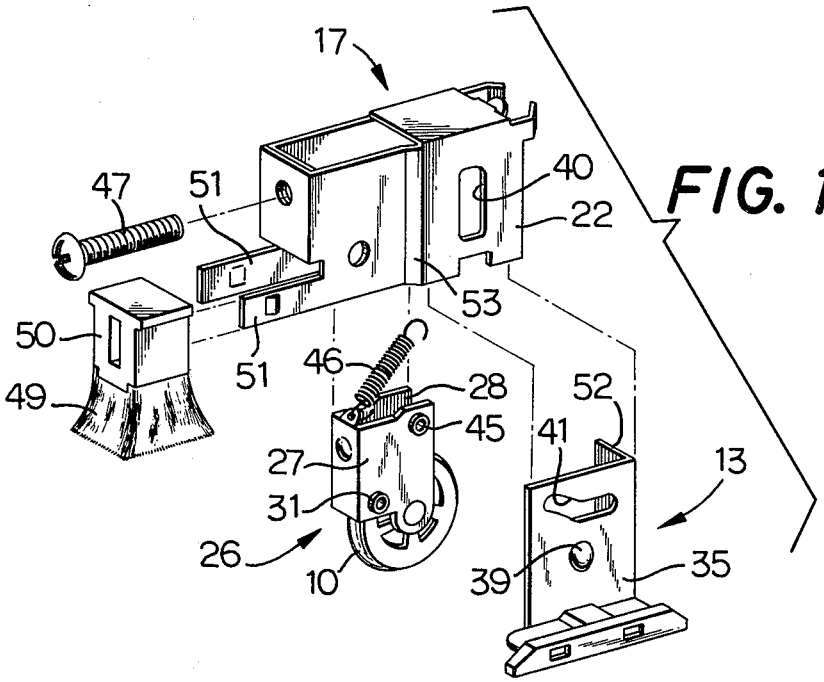
FIG. 12 is an exploded prespective view of another embodiment of the roller assembly of this invention.

Another embodiment of the roller assembly according to this invention is illustrated in FIG. 12 as an exploded perspective view. In respect of the structure it is almost similar to the previous embodiment. By allotting same numerals and signs to the similar parts and omitting superfluous description, only different places will be explained, two of those being as follows: (1) A supplementary wall 52 is installed, which is perpendicularly bent inwardly, along the vertical end wall 20 of the outer housing 17, being extended from one side of the vertical wall 35 of the engagement arm 13 nearer to the vertical end wall 20; and (2) a single vertical slit 40 for guiding one protrusion 39 formed on the vertical wall 35 is formed in the side wall 22 of the outer housing 17.

The engagement arm 13 is therefore guided upwards and downwards by the protrusion 39 which is fitted in the slit 40, because the vertical wall 35 of the arm 13 is, being situated between the side wall 27 of the inner housing 26 and the side wall 22 of the outer housing 17, regulated of its lateral movement by a stepped portion 53 and the vertical end wall 20 of the outer housing 17.

Figure 13:
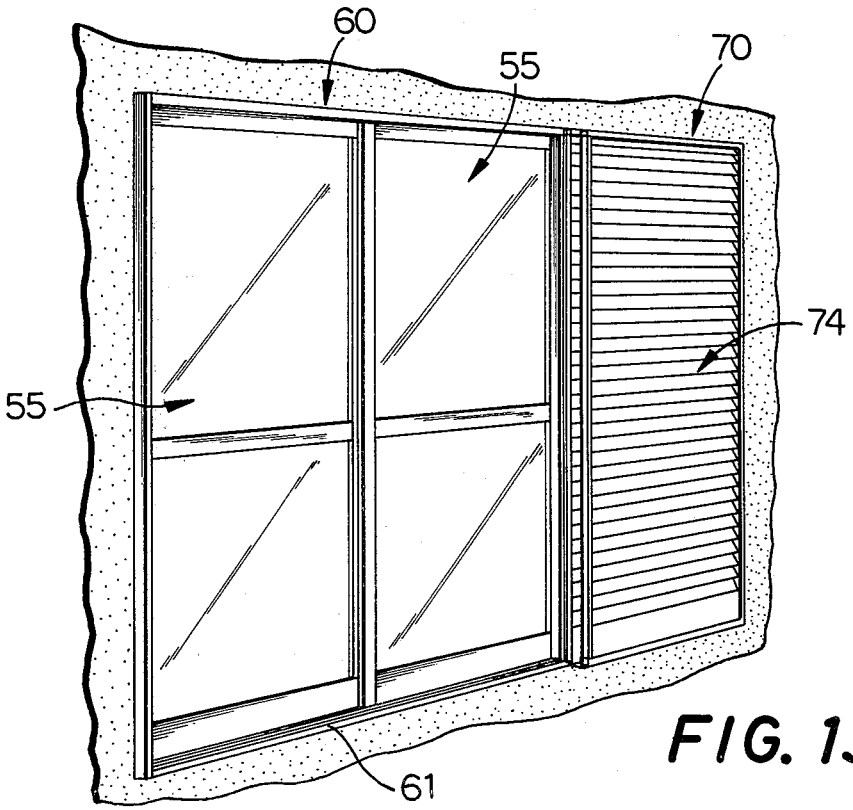
FIG. 13 is a perspective view of an example of a sliding door arrangement attached to an opening of a home or house.
Figure 14:
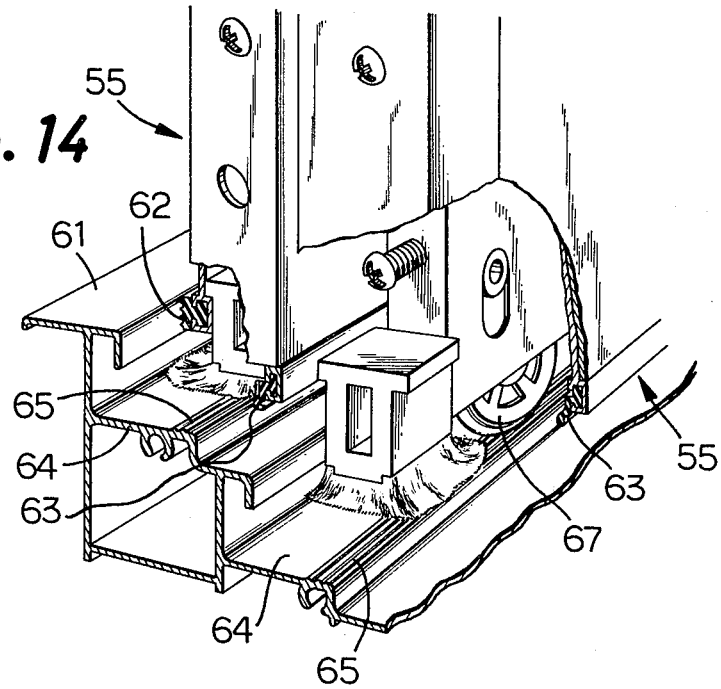
FIG. 14 is a perspective view, partially broken away, of a part of a lower frame in a structure frame to which sliding doors are attached.
Figure 15:
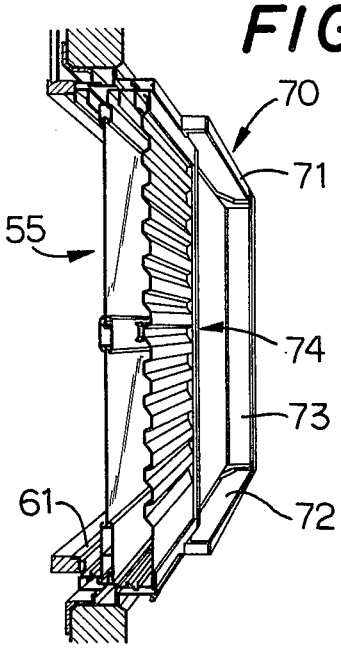
FIG. 15 is a perspective view of the sliding door arrangement in FIG. 13 shown vertically cut at the vertical structure frame portion.

Further concrete example of a sliding closure provided with a roller assembly in accordance with this invention is shown as an explanatory perspective view in FIGS. 13 through 15.

The illustration contains a sliding glass door arrangement with a door storage or case which is attached to an opening in a home or house. The sliding glass door arrangement is composed of (i) a plurality of sliding glass doors 55, two in number here in this example, put in (ii) a frame portion 60 movably relative to one another in spaced-apart parallel planes and (iii) a door storage 70. The frame portion 60 and the door storage 70 are respectively assembled as already known of a combination of extruded parts of aluminum or its alloy. A lower frame 61 in the frame portion 60 is of stepped structure as shown in FIG. 14 constituted of plural steps, on each of which one sliding door 55 being adapted to be put in. Putting mechanism of such sliding doors 55 on the lower frame 61 is similar to the previous example, requiring no superfluous description. What draws attention is that the door 55 is provided, on either the outer side and the inner side on the bottom portion thereof, that is to say the side faced outside, right in FIG. 14, and the side faced inside of the house, left in FIG. 14, with seals 62, 63 for the purpose of giving improved air-tightness and preventing ingress of dust into the house; and that door running flat surfaces 64, 64—are respectively provided with a plurality of low parallel ribs 65 extending along the door running direction. On those ribs 65 a roller 67 of a roller assembly 66 is supposed to run along.

The door storage 70 includes as shown in FIG. 15 upper and lower holding plates 71, 72 and a vertical end wall plate 73, with the front side being open. A plurality of sliding shutter doors 74 adapted to run along in series on a track disposed on a flat portion located on the outermost side of the frame portion 60, the lowest step portion in the lower frame 61, are accommodated one after another into the door storage 70. Besides, some other devices are of course permissible, such as the door storage 70 made into a known closed type including a cover plate on the front side thereof, and disposition of a known screen door(s) for keeping off insects between the shutter door 74 and the sliding glass door 55 so as to be run on the frame portion 60.

In a sliding door arrangement of such structure, opening and closing of an opening of a house can be carried out by means of sliding glass doors 55 parallelly, and covering protection from rain and wind of the sliding doors can be performed by covering the frame portion 60 with the shutter doors 74 drawn out of the door storage 70 one by one.

Although the invention has been shown and described with respect to certain preferred embodiments, it is obvious that equivalent alterations and modifications will occur to those skilled in the art upon the reading and understanding of the specification. The present invention includes all such equivalent alterations and modifications and is limited only by the scope of the claims.

What is claimed is:

1. In a sliding closure which is mounted on a structure defining an opening and which moves toward and transversely to a plane in which said opening lies for moving a portion of said closure in a direction toward said plane, a roller assembly which is to be disposed at least one at the lower portion of said structure for being moved in rotation on a substantially flat surface situated on a lower frame of said structure, being built into a step-like form, said roller assembly comprising:

a roller body;

an inner housing having a first rotation axis for rotatably retaining said roller body;

an outer housing attached to said closure for accommodating said inner housing therein so as to be rotatable about a pivotal second axis which is located at a separate position from, and is parallel to, said first axis;

a biasing means anchored between said inner housing and said outer housing for biasing said inner housing rotatably about said second axis such that at least a part of said roller body can be exposed outside from a lower opening of said outer housing; and an engagement arm means which is vertically movable according to the rotational movement of said inner housing about said second axis and is thereby capable of preventing said closure from getting out of the structure by means of being engaged, when it is ascended, with a guide groove which is formed on a vertical wall portion of said steplike form along the longitudinal direction thereof.

2. Roller assembly in accordance with claim 1, wherein said engagement arm means is, when said roller body has been moved vertically by a predetermined amount relative to said outer housing, capable of vertically moving relative to said outer housing by a larger distance than, or an approx. equal distance to, said predetermined amount.

3. Roller assembly in accordance with claim 1 or claim 2, wherein said engagement arm means comprises an internal sliding portion which is interposed between said inner housing and said outer housing, being engaged with said inner housing via an engaging mechanism, for being slidable vertically between both housings according to rotational movement of said inner housing, a connecting portion extending laterally from the lower portion of said internal sliding portion by way of an opening end on the lower side of said outer housing, a rising portion upwardly bent from the end of said connecting portion, and an engagement member attached to said rising portion for being slidably engaged with said guide groove in said structure.

4. Roller assembly in accordance with claim 2, wherein said engagement arm means comprises an internal sliding portion which is interposed between said inner housing and said outer housing, being engaged with said inner housing via an engaging mechanism composed of an engaging protrusion formed on the inner housing and a slit movably accommodating said engaging protrusion therein, for being slidable vertically between both housings according to rotational movement of said inner housing, a connecting portion extending laterally from the lower portion of said internal sliding portion by way of an opening end on the lower side of said outer housing, a rising portion upwardly bent from the end of said connecting portion, and an engagement member attached to said rising portion for being slidably engaged with said guide groove in said structure.

5. Roller assembly in accordance with claim 4, wherein said slit of said engagement mechanism is composed of an arcuate portion and a straight line portion connected thereto.

6. Roller assembly in accordance with claim 4, wherein said internal sliding portion of said engagement arm means is provided with a guide protrusion, and said outer housing is provided with a vertical guide slit at a corresponding portion thereof to said guide protrusion, said engagement arm means being guided in respect of its vertical movement through guiding of said guide protrusion within said guide slit.

7. Roller assembly in accordance with claim 1, wherein an adjusting means is disposed in said outer housing for regulating rotational movement of said inner housing about said second axis so as to adjust the rotational amount thereof.

8. Roller assembly in accordance with claim 1, wherein both the inner housing and outer housing are all products of steel plates formed by bending the same.

9. Roller assembly in accordance with claim 8, wherein said second axis comprises a pair of cylindrical pivots formed integrally with said inner housing by outwardly erecting while bending a circumferentially edge portion of a hole bored in mutually facing two side walls of the inner housing.

10. Roller assembly in accordance with claim 4, wherein said engaging protrusion, which is adapted to be engaged with said slit in the internal sliding portion of said engagement arm means, is a cylindrical portion integral with said inner housing formed by erecting while bending a circumferential edge of a hole bored in a side wall of said inner housing faced said internal sliding portion in a direction toward said internal sliding portion.

11. Roller assembly in accordance with claim 2, wherein said engagement arm means can be adjusted, when it is lowered to the lowest position, such that the lower end thereof may be aligned with the lower end of said roller body at an approx. same level.

* * * * *